United States Patent [19]

Tetelman et al.

[11] Patent Number: 4,859,839

[45] Date of Patent: Aug. 22, 1989

[54] POINT-OF-SALE TERMINAL FOR LAUNDRY OR DRY CLEANING ESTABLISHMENTS

[75] Inventors: Bruce Tetelman, Fort Lee, N.J.; Yannis Milios, New York, N.Y.; Il-Pyung Park, Palisades Park, N.J.; Tom Recht, Forest Hills, N.Y.

[73] Assignee: Counter Computer Corporation, Westbury, N.Y.

[21] Appl. No.: 216,885

[22] Filed: Jul. 8, 1988

[51] Int. Cl.[4] ..... G06F 15/24

[52] U.S. Cl. ..... 235/385; 235/375; 235/383; 235/487

[58] Field of Search ..... 235/375, 383, 385, 487

[56] References Cited

U.S. PATENT DOCUMENTS 4,550,246 10/1985 Markman ..... 235/385

*Primary Examiner*—Harold I. Pitts

*Attorney, Agent, or Firm*—Brumbaugh, Graves, Donohue & Raymond

[57] ABSTRACT

A computerized point-of-sale terminal for use in laundry and dry cleaning establishments includes a keyboard for entering items to be laundered or dry cleaned, characteristics of the entered items, and services to be performed on the entered items, and a printer for printing a ticket. The terminal also includes a stationary bar code reader positioned to read a bar code on a ticket being moved by the ticket transport mechanism of the printer. The printer, ticket transport mechanism and bar code reader are all controlled by programmed routines being executed by the computer of the terminal. By using a single ticket transport mechanism for both the printer and the bar code reader, the number of parts as well as the weight and bulk of the terminal is reduced.

5 Claims, 4 Drawing Sheets

POINT-OF-SALE TERMINAL FOR LAUNDRY OR DRY CLEANING ESTABLISHMENTS

BACKGROUND OF THE INVENTION

The present invention relates to point-of-sale terminals, and more particularly to an improved point-of-sale terminal for use in laundry and dry cleaning establishments. When a customer brings items to be laundered or cleaned to the counter operator of a laundry or dry cleaning establishment, it is common practice for the operator to prepare and give to the customer a ticket listing the items received. It is further common to indicate on the ticket the services to be performed on each item and the price to be charged, which is dependent on the number and types of items, and the services to be performed on each item.

Traditionally the ticket is handwritten by the operator. However, writing tickets by hand has the problem in that errors may occur because of memory lapses as to established base prices and upcharges for various items and services or errors in operator judgment as to item characteristics relevant to base price or upcharge determination. In a busy establishment, the pressure of time may promote even more errors. Depending on the nature of the error, the customer or store owner may be dissatisfied.

Writing tickets by hand offers the further disadvantage that the ticket-writing activity, which can take a minute or more, occupies the time of two people—the operator and the customer—from start to finish.

In addition, with handwritten tickets there can be arithmetic errors in summing the items and applying discounts, coupons, taxes, and the like. Further difficulties arise if the handwriting on the ticket is not legible.

In the face of the many drawbacks of handwritten tickets, examples of which are discussed above, in recent years it has become commonplace to attempt to use computer technology in point-of-sale applications.

By incorporating a computer in a point-of-sale terminal, arithmetic functions may be provided for calculating the total of the item prices and taxes after the operator has entered the necessary information, and a ticket may be automatically printed under the control of the computer. The ticket printed by such a terminal is not subject to variable legibility as is the handwritten ticket.

Prior art computerized point-of-sale terminals, while providing numerous advantages over handwritten tickets, do not, however, remedy all of the problems associated with handwritten tickets.

For example, as mentioned above, the customer who leaves items to be laundered or dry cleaned typically has been given a ticket in exchange for the items. Where the ticket was printed under computer control rather than handwritten, information pertaining to the incoming order has been entered into the computer. A number on the ticket has been read and stored in the memory of the computer, typically along with information about the date, time, operator, and items and descriptors. When the customer returns to the laundry or dry cleaning establishment to pick up the laundered or dry cleaned items, he or she is normally required to present a ticket to permit the operator to locate the customer's items and verify that the customer is entitled to receive such items. Generally, if the customer does not have the ticket, it becomes very difficult for an ordinary laundry or dry cleaning establishment to locate the customer's laundered or dry cleaned items based on the customer's oral description of such items, assuming that the operator is convinced that the ticketless customer is entitled to the items being claimed. In many laundry or dry cleaning establishments the laundered or cleaned items are stored on a mechanized moveable rack with numbered storage locations. To retrieve an item being claimed by a customer, the operator must read a number from the ticket presented by that customer and look for that number on the moveable rack. In some instances retrieval of items on the rack, based on the number on the ticket, is automated.

In dry cleaning or laundry establishments, as in many other businesses, it is desirable to be able to account for all outstanding tickets. As each ticket is returned, the returned ticket must be reconciled against a record of outstanding tickets. In an establishment with a computerized point-of-sale terminal, such reconciliation of outstanding tickets is easily accomplished within the terminal using the information typed into the terminal when a ticket is issued and when a ticket is returned.

But relying on the human operator to read a ticket number and to enter it manually into the point-of-sale terminal is costly in terms of the time required for each such entry. Furthermore, there is the possibility of typographical error as the operator enters the number. Such error, if not corrected at the time of entry, may result in inaccuracies in the transactions processed by the point-of-sale terminal.

To facilitate the accounting of outstanding tickets, bar codes have heretofore been used on the tickets. Such bar codes are scanned by an operator when tickets are presented typically by using a handheld bar code reader. Each ticket bears a different bar code, printed beforehand either at the time the ticket form is manufactured or at the time the ticket is issued.

Reading of a ticket bar code at the time of the incoming order, and again at the time the outgoing items are returned to the customer, permits enhancement of the normal functions of the point-of-sale terminal. As mentioned above, it is desirable to keep inventory information about the outstanding tickets. When a ticket is issued to a customer, the ticket represents items that are considered to be in inventory. Later, when the ticket is presented by the customer and items are returned to the customer, the ticket records the items that leave the inventory. Thus, the use of bar codes makes the inventory updating a straightforward matter.

When the ticket is presented by the customer, the terminal is able to read the bar code and retrieve from memory the information necessary to handle the cash transaction with the customer. This information may, for example, include the total price that was printed on the ticket at the time it was issued.

Similarly, cashing out the cash drawer of the terminal at the end of the day is more easily performed if the point-of-sale terminal has kept track, by number, of the tickets which have been returned. As mentioned above, already stored in memory prior to the return of the ticket was information about the ticket, including the total cash amount for the ticket.

The handheld bar code reader is commonly available in one of two types. One type requires the operator to "swipe" the bar code by moving the reader or wand at near-constant velocity over the bar code from one end to the other. Another type of handheld bar code reader is used by placing the reader or wand over the bar cod and keeping it stationary in that position until the scanning of the bar code is complete. Such a reader or wand contains a mirror controlled by a servomechanism to sweep a beam of light across the entire bar code so that light reflected from the bar code may be sensed by an appropriately positioned light detector, which reads the bar code.

Each of these commonly used handheld bar code readers has its respective drawbacks. The hand swept type of bar code reader must be moved at nearly constant velocity across the entire bar code, a technique many operators have difficulty performing consistently. The stationary type of handheld bar code reader tends to be bulky, expensive, and less sturdy, due to the presence of a servomechanism and mirror in such devices.

Any handheld bar code reader has a drawback in that it has an attached cord which may be damaged or become tangled with garments or other objects, and the reader itself may be dropped and damaged.

Another known bar code reader technology is the under-the-counter bar code scanner recently being used in supermarkets and other stores. Such a scanner typically has a light source and servomechanism controlled mirrors located beneath a counter-level window for sweeping a light beam across a bar code on an item of merchandise being moved across the window. Appropriately positioned light detectors sense the light reflected from the bar code and thereby read the bar code. But some such readers require the operator to move the item bearing the bar code across the window at a nearly constant velocity, an operation which is difficult to perform consistently.

The under-the-counter type bar code scanner is unsuitable for use in a point-of-sale terminal for laundry or dry cleaning establishments because such a scanner has sophisticated features designed for reading bar codes on objects of various shapes and orientations. These features, which are provided at considerable additional cost, are not needed for reading a bar code on a laundry or dry cleaning ticket. Such readers also are bulky.

Where a bar code reader is mounted within a point-of-sale terminal, the problem of moving the ticket at rear constant velocity past the bar code reader may be alleviated by providing a motor driven ticket transport mechanism with the bar code reader. But such a separate transport mechanism tends to increase the cost and size of the point-of-sale terminal, since it is present in addition to all the other components of the terminal.

Accordingly, a need clearly exists for a point-of-sale terminal for use in laundry and dry cleaning establishments in which a stationary bar code reader is provided for reading bar codes on tickets without the need for the operator to move either the reader or the ticket at nearly constant velocity.

Additionally, a need clearly exists for a point-of-sale terminal for use in laundry or dry clearing establishments in which a stationary bar code reader is provided within the terminal to read bar codes printed on tickets without the need for providing a separate ticket transport mechanism for the bar code reader.

SUMMARY OF THE INVENTION

In accordance with the present invention, a point-of-sale terminal is provided which substantially overcomes the problems of the prior art as described above.

The point-of-sale terminal in accordance with the present invention comprises a custom keyboard with key arrangement and labelling designed for use in a dry cleaning or laundry establishment for entering ticket information, display means for displaying ticket formation, memory means for storing ticket information, ticket printing means disposed to print appropriate information on a ticket being moved by ticket transport means, bar code reading means disposed to read a bar code on a ticket being moved by the ticket transport means, and control means for controlling the keyboard, the display, the ticket transport means, the ticket printing means and the bar code reading means, including appropriately moving a ticket relative to the printing means for the printing means to print the appropriate information thereon, and for appropriately moving a ticket relative to the bar code reader for the bar code reader to read a bar code thereon.

In a preferred embodiment of the terminal, the control means comprises a microprocessor executing a stored program.

DETAILED DESCRIPTION OF THE PREFERRED EMBODIMENT

Figure 1:
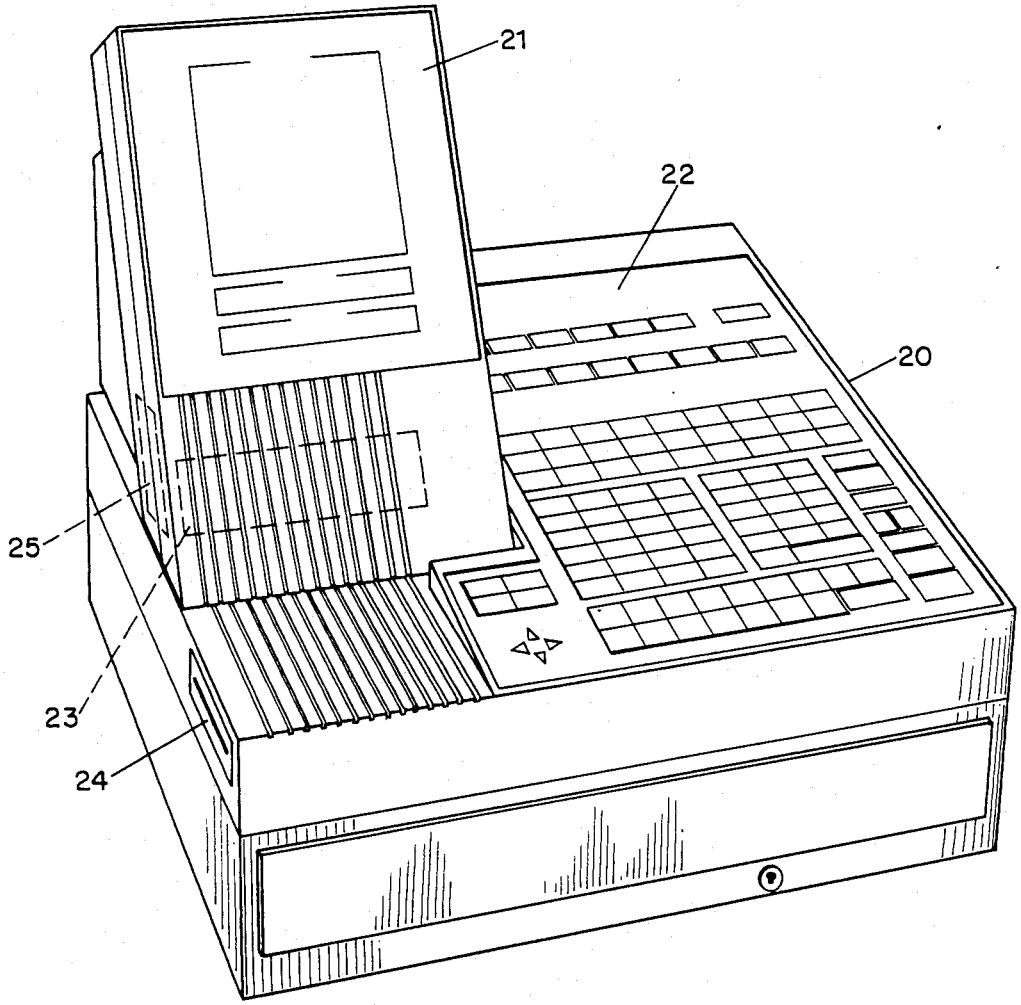
FIG. 1 is an isometric view of an exemplary embodiment of the point-of-sale terminal of the invention.

As shown in FIG. 1, the point-of-sale terminal according to the invention comprises a case 20, a display screen 21, a customized membrane keyboard 22, a printer 23 including a ticket transport mechanism (not shown in FIG. 1), a floppy disk drive 24, and a stationary bar code reader assembly 25 positioned to read a bar code on a ticket in the ticket transport mechanism of the printer 23. When a customer presents some clothing items for dry cleaning or laundering, the operator makes entries at the keyboard 22. The terminal displays information at the display 21, showing the entered information, or in the event of an erroneous keyboard entry, showing an error message. The operator inserts a blank ticket into the printer 23, and when the keyboard entries are complete, the printer prints a ticket being moved past the printer head by the ticket transport mechanism, listing the items received, the services to be performed on the items and the prices for such services. Before, after, or during the printing, a bar code on the ticket is being read by the bar code reader 25 under the control of a program being executed by a central processing unit in the terminal.

Floppy disk drive 24 may contain a disk storing the terminal application software and data (if the terminal is not equipped with a hard disk) or may be left empty.

Figure 2:
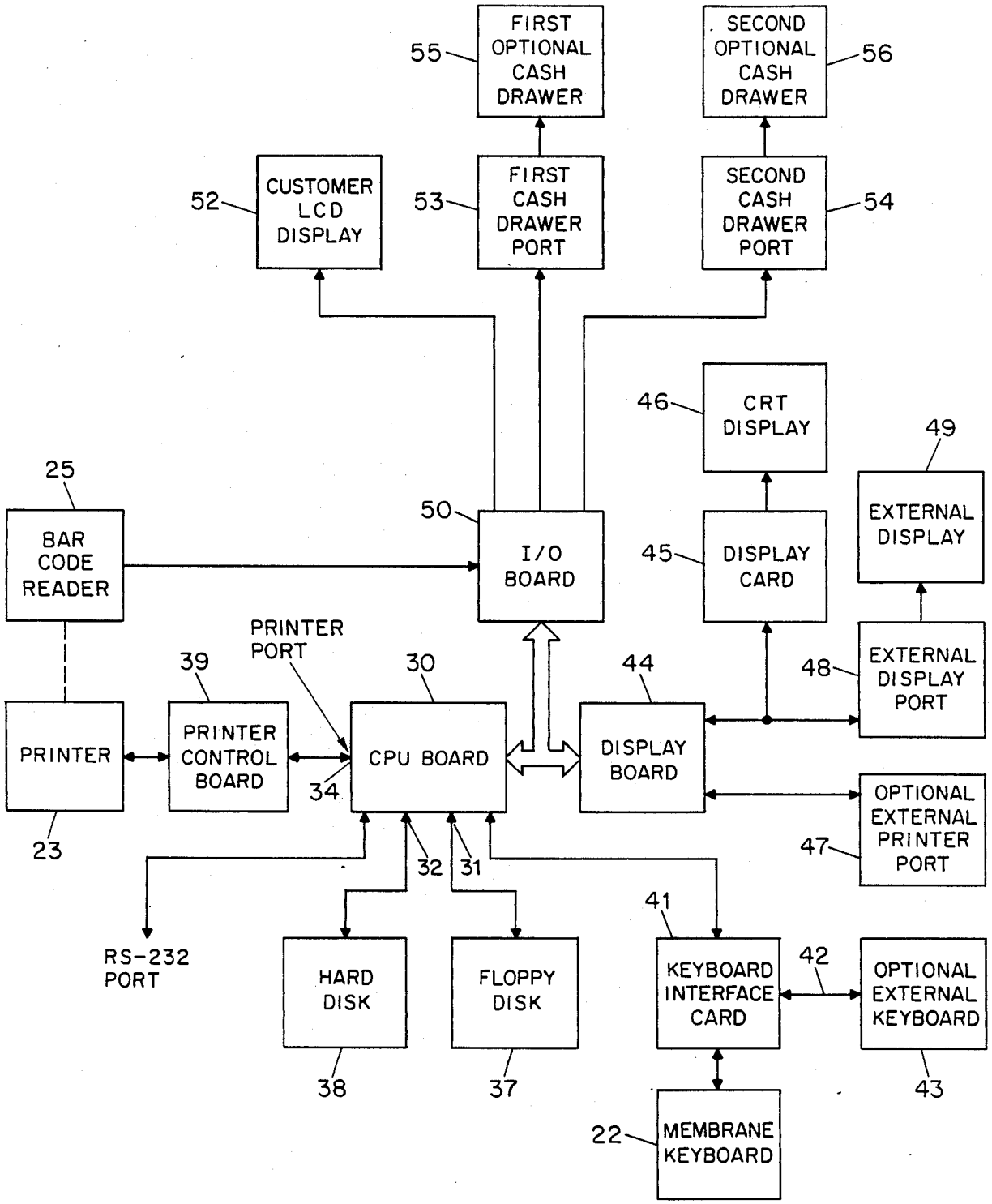
FIG. 2 is a functional block diagram for the hardware of the terminal of FIG. 1, including I/O board 50.

FIG. 2 shows a functional block diagram of the terminal. CPU board 30 is a conventional IBM PC-compatible main logic board, with port 31 for a conventional floppy disk drive, port 32 for a conventional hard disk drive, port 33 for a conventional RS-232 interface, port 34 for a conventional Centronics-standard printer interface, port 35 for a conventional IBM PC-type keyboard, and port 36 for a conventional IBM PC-type data bus. Not shown is the power supply, which is a conventional power supply adapted to draw its power from an AC power receptacle and to supply the necessary voltages to the many parts of the terminal. One suitable power supply is a Powerline model PX7048C power supply, in combination with a conventional power line filter such as a Schurter model KSB4302500 filter. Also not shown is a clock-calendar module connected with the CPU board 30, such as a Dallas Semiconductor model DS1216C clock-calendar.

Connected to the floppy disk port 31 is a conventional 3½ inch floppy disk drive 37. Connected to the hard disk port 32 is a conventional hard disk drive 38. In the exemplary embodiment described herein, the conventional IBM PC-compatible main logic board is an Ampro model 4B4 board; the floppy disk drive is a Panasonic model JU253T; and the hard disk is a Miniscribe 8425S.

In the exemplary embodiment, ticket printer 23 does not conform to the Centronics standard of port 34. Therefore, the printer control board 39 is provided to receive Centronics signals from port 34 and to translate them into signals capable of driving printer 23. The printer control board 39 also receives information from printer 23 and converts that information into Centronics signals for transmission to printer port 34. For example, an Epson slip printer model M290 may be used, along with an Epson model BA290 printer controller board.

A custom-made membrane keyboard 22 is divided electrically into rows and columns, and pressing a key generates a key closure signal representative of its particular row and column. Row and column signals from the keyboard 22 are processed by keyboard interface card 41, and through hardware and software are made available to the user program via the standard keyboard input buffer. One way to do this is to provide a keyboard interface card 41 which generates conventional IBM-PC format keyboard signals for keyboard port 35. Keyboard interface card 41 also provides an external keyboard port 42, to which may be connected an optional external keyboard 43; the external keyboard may be any standard IBM PC-compatible keyboard, such as a BTC model BTC-5060.

The IBM PC-compatible CPU board 30 has a port 36 mentioned above, which port carries a bus with well-known data, address, and control signal lines capable of interfacing with conventional IBM PC-compatible plug-in cards and the like. In the exemplary embodiment, a conventional CRT display board 44 is attached to the port 36. The display board 44 receives signals from the CPU board 30 representative of data to be displayed, and makes that data available in appropriately translated form to display card 45 and also to an external display port 48. An optional external display 49 capable of presenting RGB digital information may be connected to external display port 48. Display card 45 generates signals sufficient to drive CRT display 46 with conventional text and graphics information. Display board 44 may be any conventional IBM PC-compatible CGA card with an RGB digital output and a Centronics printer port. One card which may be used is an International Keytech model KS1617.

Display card 45 and CRT display 46 may be any display unit capable of displaying RGB digital information. For example, a Dotronix model 961 unit may be used for the display card 45 and the CRT display 46. In the exemplary embodiment, CRT display 46 is oriented as portrait display (with the long dimension vertical) rather than the more commonly used landscape display (with the long dimension horizontal). For such display orientation, the Dotronix model 961 board must be appropriately modified in a manner well known to those skilled in the art. However, the invention may be practiced with any display capable of displaying alphanumeric characters regardless of whether it is oriented for landscape or portrait display. The CRT display 46 is preferably equipped with a glare filter such as a Doy-Tech model 20647M filter.

Display board 44 also provides signals for an optional Centronics printer port 47, accessible to the user at a connector on the outside of the case 20. External keyboard port 42 and external display port 48 are likewise accessible to the user at connectors on the outside of case 20.

Also connected to port 36 is an I/O board 50. I/O board 50 receives data from bar code reader 25, and provides it upon request to CPU board 30. I/O board 50 also receives, processes, and provides signals from CPU board 30 for controlling the customer LCD display 52, a first optional cash drawer through port 53, and a second optional cash drawer through port 54. First and second optional cash drawers 55 and 56 may be connected to first and second optional cash drawer ports 53 and 54.

In the exemplary embodiment, the bar code reader 25 is a Welsh-Allyn model CMM bar code reader; the customer LCD display 52 is a Densitron LM4012BGICIGCT back-lit LCD display; and the optional cash drawers 55, 56 are APG model TTLMID12D201-1 cash drawers.

Figure 3:
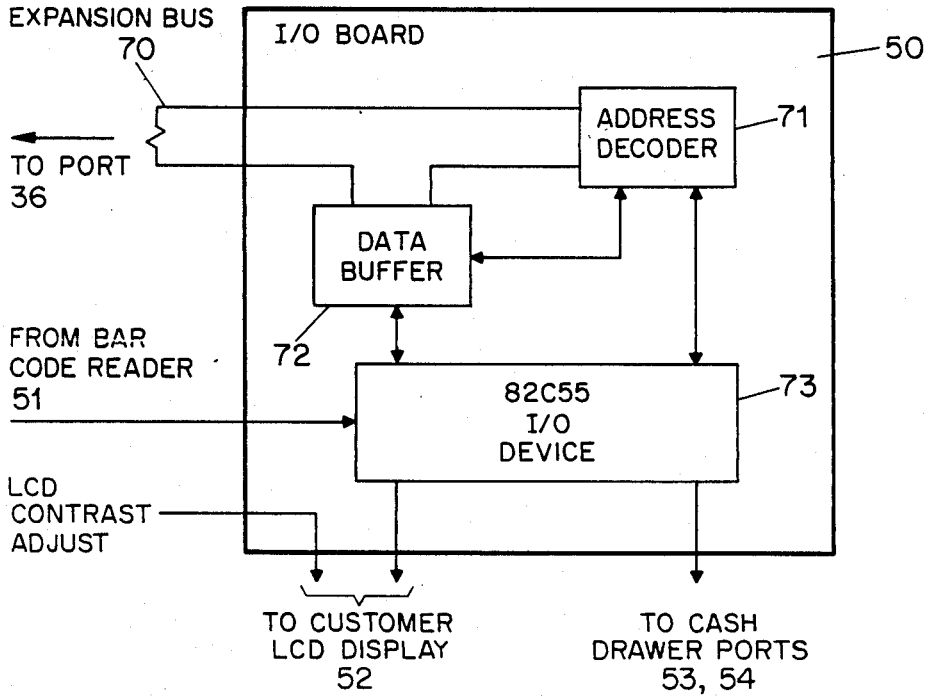
FIG. 3 is a functional block diagram for the I/O board 50.

The internal function of I/O board 50 is disclosed in greater detail in FIG. 3. As may be seen in FIG. 3, expansion bus signals 70 from port 36 of the CPU board 30 received by the I/O board are provided to address decoding circuitry 71 and data buffer 72. Data flow between CPU board 30 and I/O board 50 is according to well-known conventional IBM PC-compatible bus protocols. When address decoder 71 detects a data read or data write signal on the expansion bus, it checks to see if the data read or data write signal is directed toward one of the predetermined addresses associated with I/O board 50. If so, address decoder 71 activates data buffer 72 and I/O device 73 to perform the data transaction. If the signal is a data write signal, data from the expansion bus is gated by data buffer 72 to the I/O device 73. If the signal is a data read signal, data from the I/O device 73 is gated by data buffer 72 to the expansion bus. Depending on the particular address decoded by the address decoder 71, I/O device 73 is directed variously to collect data from bar code reader 25, to send data to LCD display 52, or to send data to cash drawer ports 53 and 54. The output signals of I/O device 73 provided to LCD display 52 and cash drawer ports 53, 54 are latched, in that they remain unchanged until such time as the I/O device 73 is loaded with new data from port 36.

Figure 4:
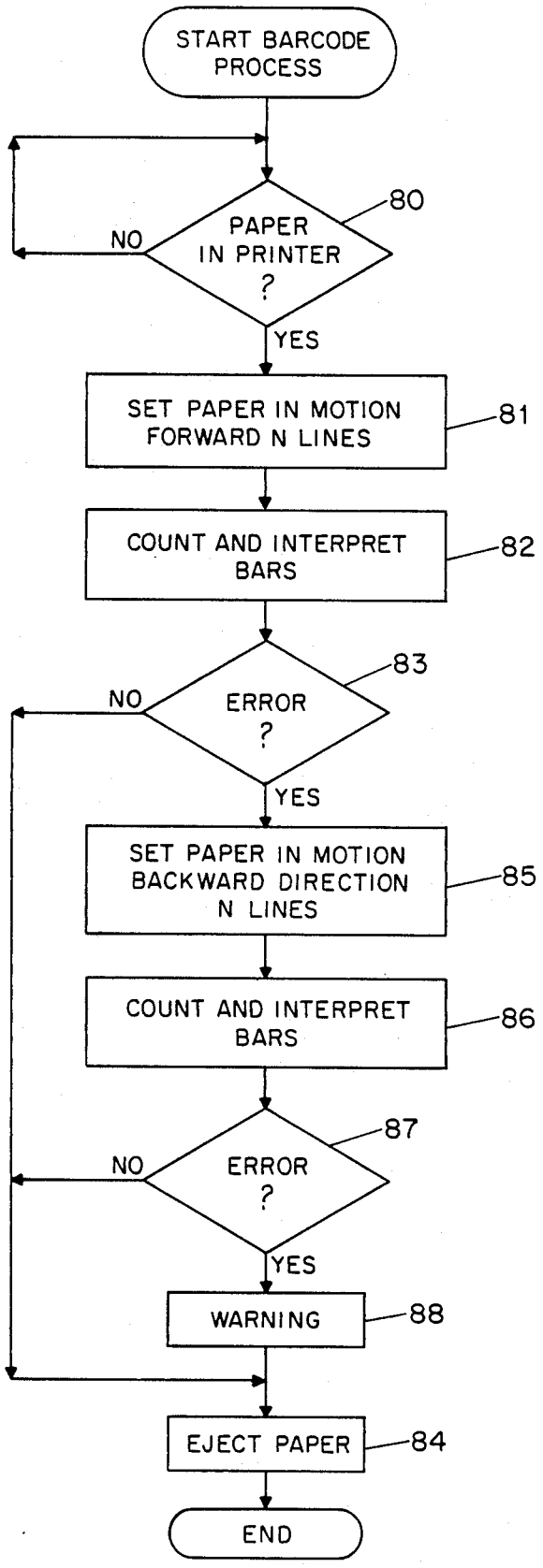
FIG. 4 is a flow chart representative of an exemplary program routine for controlling the terminal of FIG. 1.

The behavior of the terminal 20 is determined by the application program in the terminal, which according to the exemplary embodiment runs under MS-DOS. FIG. 4 is a flowchart representative of a portion of the application program of the exemplary embodiment. A source code listing of the portion of the application program pertaining to the control of bar code reader 25, printer 23 and the ticket transport mechanism of the printer, according to the exemplary embodiment, is included at the end of the specification. As noted above, the ticket transport mechanism of the printer 23 may be controlled independently of the printer and is shared with the bar code reader 25.

When power is applied to the point-of-sale terminal, the CPU board executes well-known ROM software causing an orderly power-up and transfer of control to well-known disk operating system (MS-DOS) routines on disk. These DOS routines eventually transfer control to the application program specific to the point-of-sale terminal functions. That program also performs a number of initialization steps.

After the conventional initialization steps are completed, the terminal is prepared to accept information relating to items presented by a customer for dry cleaning, laundering, or other services. As shown in FIG. 2, a keystroke is first made known to the terminal at membrane keyboard 22, is conveyed electrically to keyboard interface card 41 and enters the CPU board 30 at keyboard port 35. Hardware within CPU board 30 receives the keyboard signals, and makes them available to software by well-known means general to all IBM PC-compatible computers. Depending on the keystroke physically detected at membrane keyboard 22, a numerical value or sequence of numerical value is processed by hardware and normal MS-DOS and BIOS software, and made available to the user program via the standard keyboard buffer. For example, pressing the numeral key "1" causes the CPU board to make the decimal value "49" available to software.

Though not explicitly represented in FIG. 4, throughout execution of the program, appropriate information relating to the transaction controlled by the program is provided on the customer LCD display 52 and on the CRT display 46.

Further, erroneous or inappropriate keystrokes are detected and responded to by the program. For example, an error message may appear on the CRT display 46, followed by a beep tone generated under control of the program by CPU board 30.

In accordance with the exemplary embodiment, the program also permits user entries for editing information which has earlier been typed in. For example, cursor control keys and editing keys are provided on the keyboard and handled by the program so as to permit such editing.

The program according to the exemplary embodiment also provides for storing or manipulating a variety of pieces of information which, though unrelated to the invention disclosed here, are nonetheless of utility to the operator. For example, statistical information is maintained showing how many shirts were cleaned, how many skirts, and so on. Financial totals may be kept which assist the manager of the dry cleaning or laundry establishment in reconciling the cash drawer contents at the end of the day. The program may, for example, permit the printing of reports satisfying a variety of management needs. Such provisions may be accomplished by programming methods well known in the art and will not be discussed further here.

It should be understood that if the keyboard is a membrane type keyboard, principles of design may suggest that a click be generated by hardware or software so that the user has feedback of the successful key closure. The well known programming techniques for accomplishing a key click in software may be implemented by those skilled in the art and will not be discussed further here.

After power-up, other steps not part of the invention are performed, and a point is reached at which it is appropriate to read the bar code of a ticket. This is depicted in FIG. 4 starting with the block labelled "start barcode process". The barcode reading process is performed by the function GETBC listed in the program listing below. First, a test is made to determine whether thee is a ticket in the printer. This is done by interrogating the printer, which uses LED-phototransistor pairs to sense presence of the ticket. If the test fails, control returns to block 80 and the test is repeated, until such time as a ticket is detected. When a ticket is detected, control passes to block 81. The paper is set in motion by means of an appropriate command to the printer. In the exemplary embodiment, the command sent to the printer causes it to move the ticket a specified distance, which distance is selected to span the entirety of the bar code and some distance beyond. Such ticket motion is now explained with reference to FIG. 5, in which a side view of a portion of the ticket transport mechanism of the printer 23 and of the bar code reader 25 is depicted. Rollers 90, 91 of the ticket transport-mechanism grip ticket 92, so that when roller 91 rotates counterclockwise the ticket moves to the left. Motion of ticket 92 to the left and right of rollers 90, 91 is controlled by bed 93 and guide 94. Roller 91 is driven by a stepper motor (not shown in FIG. 5) controlled by signals originating from the central processing unit, while roller 90 would rotate freely but for its contact with roller 91 or ticket 92 or both.

As ticket 92 moves to the left, a bar code, if properly positioned, passes under and is read by bar code reader 25. Once the command has been sent to the printer, control passes to block 82, which in the software listed below represents an invocation of the CODABAR function. CODABAR then invokes the BARCODE routine, listed with file name TEST3.ASM in the listing. BARCODE collects information from the barcode reader 25, and counts the bars and spaces, and passes the bar and space information back to CODABAR, which interprets the information to derive the symbol value of the bar code. In the point-of-sale terminal, the symbol value is the ticket number, also printed in human-readable alphanumeric characters.

The printer, which prior to the invocation of CODABAR had been requested to move the ticket some fixed distance, has continued moving the ticket so as to eventually reach that distance. Thus the ticket movement does not require continual supervision by software.

Rollers 90, 91, guide 94, and character forming means 95, discussed below, are all conventional elements of well-known ticket printer 23. As mentioned above, the bar code reader 25 is a commercially available unit. In the terminal of the invention the reading of the bar code is accomplished without the necessity of manually moving the ticket at nearly constant-velocity by a human operator, and requires only a conventional bar code reader 25 and hardware elements of printer 23, together with appropriate control software, an example of which is included in the appended source code listing.

Figure 5:
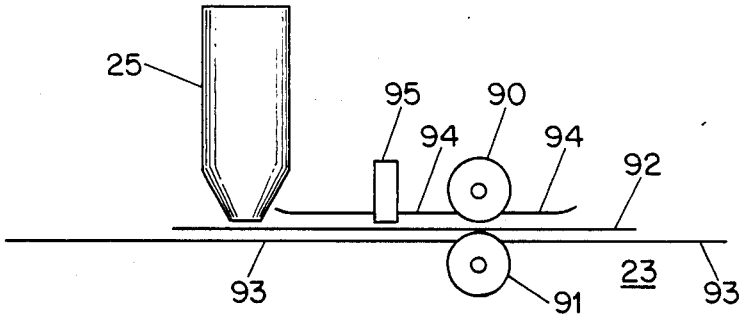
FIG. 5 is a side view of the bar-code reader and a portion of the printer of the terminal of FIG. 1.

Forward movement of the ticket may be understood by reference to FIG. 5. Ticket 92 passes to the left in response to counterclockwise rotation of roller 91.

It should be understood that the ticket transport function carried out by rollers 90, 91, and guide 94 is well known in the prior art.

In addition to deriving the symbol value, the CODABAR routine performs the calculations of block 83. In accordance with well known convention, the bar code is printed to include a check sum. Then when the bar code is read, the digits of the code, obtained as a result of the read operation, are tested for correctness of check sum according to well known procedures. For example, in one checksum standard, the digits to be represented by bar code are summed to each other, one by one, and an additional digit is selected so that the total is a multiple of 9. All the digits are then recorded in the bar code, with widths and spacing of the bars selected by well-known means as a function of the digits. Later, the digits are obtained by reading the bar code, again using well-known means to translate the bars of various widths into digits. The digits are summed, and if the total fails to be a multiple of 9, it is assumed that the barcode reading process must have been erroneous.

In the exemplary terminal, the particular bar code used is Codabar. However, other known bar codes, such as UPC bar codes, may also be used. Each bar code typically has provisions, in addition to a checksum, providing additional opportunities to determine if a read just performed was unsuccessful.

Block 83 of FIG. 4 symbolizes program calculation of the checksum, which, along with tests of other well-known conditions regarding the received bar code data, determines whether the bar code read was successful. If the read was successful, the invocation of CODABAR is completed, control returns to GETBC, control proceeds to block 84, and the ticket is ejected according to program steps in GETBC. As may be seen in FIG. 5, roller 91 is caused to move clockwise, and ticket 92 is ejected from the terminal.

The other possible outcome of block 83 is the conclusion that the bar code read was unsuccessful. In this event, control proceeds to block 85. The printer means is used to eject the ticket, with ticket motion controlled so as to permit a second attempt to read the bar code, shown in block 86. With reference to FIG. 5, roller 91 rotates counter-clockwise, causing ticket 92 to move to the right. The bar code, if properly positioned on ticket 92, passes under bar code reader 25, and a second read attempt occurs, by means of another invocation of CODABAR, and thus of BARCODE.

Returning to FIG. 4, block 87 symbolizes a second program calculation of the checksum, which, along with tests of other well-known conditions regarding the received bar code data, determines whether the bar code read was successful. If the read was unsuccessful, the invocation of CODABAR is completed, control returns to GETBC, and control proceeds to block 88, where an appropriate error message is communicated to the operator.

Control then passes from block 83, 87, or 88 to the end of the program depicted in FIG. 4. It is to be understood that the program segment depicted in FIG. 4, is only a portion of a point-of-sale terminal application program providing other functions which are not part of the invention.

Figure 6:
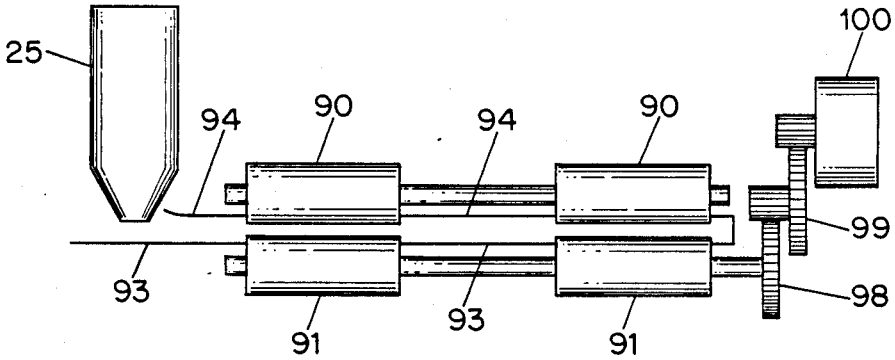
FIG. 6 is a front view of the bar-code reader and a portion of the printer of the terminal of FIG. 1.

FIG. 6 is a front view of a portion of the printer, its ticket transport mechanism, and the bar code reader, with elements numbered as in FIG. 5. Rollers 90, 91 are mounted on shafts 96, 97 respectively. Shaft 97 extends rightward to gear 98, which engages with idler 99, which engages with stepper motor 100. Well-known tensioning means, not shown, cause shaft 97 and rollers 91 to move upward and grip the ticket, not shown in this figure, at appropriate times, under program control. Idler 99 is disposed so as to permit such movement of shaft 97 yet to maintain driving engagement between gear 98 and stepper motor 100. A bar code, if properly placed on the ticket, may be read by bar code reader 25. Thus, in accordance with the present invention, the same ticket transport mechanism is used for the printer 95 and for the bar code reader 24.

Figure 7:
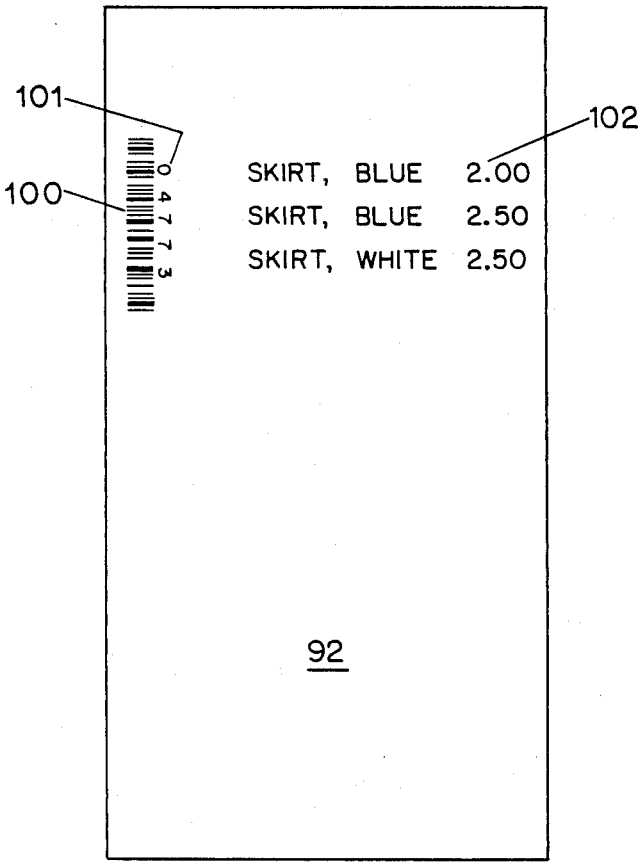
FIG. 7 is a plan view of an exemplary ticket of the type used with the terminal of FIG. 1.

FIG. 7 is a plan view of an exemplary ticket 92. Bar code 100 is oriented with bars parallel to the short dimension of the ticket 92. Lateral positioning of the bar code 100 is determined by the lateral position of the bar code reader 25, as shown in FIG. 6. Vertical positioning of bar code 100 is determined by the positioning of bar code reader 25 as shown in FIG. 5. The digits indicated by the bar code 100 are preferably printed in Arabic numerals 101 on the ticket 92, so that if the bar is damaged, the number may be read by the human operator. Information 102 printed by printer 23 is shown to the right of bar code 100.

From the foregoing, is it clear that a point-of-sale terminal has been provided, for use in laundry and dry cleaning establishments, in which a barcode reader is located stationary within the terminal to read bar codes printed on the tickets. The barcode reader is provided with ticket-transport mechanism so that there is no need for the operator to move the ticket at nearly constant velocity past the bar code reader. Furthermore, the ticket-transport mechanism is the same as that used with the ticket printer. The number of moving parts is thus minimized, as is the weight and bulk of the terminal.

As mentioned above, a source code listing of a portion of the program of the terminal of the exemplary embodiment of the invention for controlling the ticket transport mechanism and the reading and processing of the bar code is included at the end of the specification. Part of the program, procedures entitled GETBC.C and CODABAR.C, is written in C, which may be compiled by well-known means prior to execution by an IBM PC-compatible computer. The remainder of the program, procedure BARCODE, is written in assembly language, which may be assembled by well-known means prior to execution by an IBM PC-compatible computer.

It is understood that while the present invention has been described with reference to a specific exemplary embodiment thereof, various modifications and alterations may be made to the exemplary embodiment by those of ordinary skill in the art without departing from the spirit or scope of the invention as defined in the appended claims. For example, the control means for the terminal according to the invention need not be a CPU executing an appropriate program, but may be implemented entirely in hardware using well known logic design techniques, and the ticket transport mechanism shared by the bar code reader and the printer may be an integral part of the bar code reader or a separate unit, instead of being an integral part of a commercially available printer unit.

We claim:

1. A point-of-sale terminal for use in laundry or dry cleaning establishments, comprising:

keyboard entry means for entering information relating items to be laundered or dry cleaned, characteristics of such items and services to be performed on such items;

memory means for storing the information entered by the keyboard means;

ticket transport means for moving a ticket in a forward or backward direction;

printer means positioned to print ticket information on a ticket being moved by the ticket transport means;

bar code reader means positioned to read a bar code on a ticket being moved by the ticket transport means; and control means for deriving the ticket information from the information entered at the keyboard means and stored in the memory means and controlling the keyboard means, the ticket transport means, the printer means and the bar code reader means to appropriately move a ticket past the printer means for the printing of the ticket information on the ticket, and to appropriately move a ticket past the bar code reading means for the reading of a bar code on the ticket.

2. A point-of-sale terminal according to claim 1, wherein the control means moves a ticket past the bar code reader means at a substantially constant velocity to permit the bar code reader means to read the bar code on the ticket.

3. A point-of-sale terminal according to claim 1, wherein the control means comprises a central processing unit and a program stored in second memory means, the program having routines for controlling the ticket transport means, the printer means, and the bar code reader means.

4. A point-of-sale terminal according to claim 1, wherein the ticket transport means includes a stepper motor driven by periodic pulse signals provided by the control means.

5. A point-of-sale terminal according to claim 1, wherein the bar code reader means includes light-emitting means, disposed to direct a beam of light towards a ticket in the ticket transport means, and light detecting means disposed to receive light from the light-emitting means reflected from the ticket in the ticket transport means.

* * * * *